United States Patent [19]

Havener

[11] Patent Number: 4,481,857

[45] Date of Patent: Nov. 13, 1984

[54] SYSTEM FOR TUNING MUSICAL INSTRUMENTS

[76] Inventor: Richard D. Havener, 4 Whaling Dr., Waterford, Conn. 06385

[21] Appl. No.: 220,811

[22] Filed: Dec. 29, 1980

[51] Int. Cl.[3] ..... G10G 7/02

[52] U.S. Cl. ..... 84/454; 84/DIG. 18; 324/78 D; 324/80

[58] Field of Search ..... 84/454, 455, 456, 457, 84/477 R, DIG. 18; 324/78 D, 79 D, 80

[56] References Cited

U.S. PATENT DOCUMENTS

| | | | |
|---|---|---|---|
| 3,997,740 | 12/1976 | Eubank et al. | 324/79 D X |
| 4,023,462 | 5/1977 | Denov et al. | 84/454 |
| 4,175,254 | 11/1979 | Manfreda | 324/78 D X |
| 4,205,584 | 6/1980 | Foerst | 84/454 |
| 4,295,128 | 10/1981 | Hashemian et al. | 324/78 D X |
| 4,303,979 | 12/1981 | Kato et al. | 324/78 D X |

*Primary Examiner*—Stanley J. Witkowski
*Attorney, Agent, or Firm*—Albert W. Hilburger

[57] ABSTRACT

A method and apparatus including electronic circuitry for tuning a musical instrument. When a tunable vibratory or frequency producing element of the instrument is actuated, the oscillations thereby created are converted into an electrical signal. This signal is operated upon to eliminate harmonic components and is visually displayed on a readout device as a frequency registered in units of cycles per second for a predetermined period of time. If the vibratory element is actuated again within the predetermined period of time, the frequency of the new signal will be displayed, and if the vibratory element is not actuated again within the predetermined period of time, the display on the readout device will register zero.

8 Claims, 3 Drawing Figures

SYSTEM FOR TUNING MUSICAL INSTRUMENTS

BACKGROUND OF THE INVENTION

1. Field of the Invention

The present invention relates generally to an improved method and apparatus for determining and visually displaying the frequency of a vibratory element of a musical instrument. Throughout this specification, the term "vibratory element" is employed in a general sense to include all frequency producing means whether mechanical, electrical, or otherwise.

2. Description of the Prior Art

All musical instruments of the acoustical variety and especially multistringed instruments such as guitars, violins, and pianos, require periodic, even daily, tuning to insure that they consistently reproduce a proper pitch when played. In the past, in the case of the piano, this periodic tuning has been accomplished manually by a skilled craftsman employing a set of tuning forks to provide audible reference frequencies. Being of simpler construction than the piano, instruments such as the guitar and the violin are not generally tuned by such a special skilled craftsman, but rely upon the skill of the individual musician for their tuning. In any event, the use of tuning forks is inherently an inaccurate method, is slow and tedious, and in the case of multistringed instruments such as pianos, requires skill far beyond that routinely available in today's society.

Because of this situation, electronic devices have been developed to provide such periodic tuning. Known devices generally provide information in the form of a frequency difference between an input signal as generated by a vibratory element, such as a string of a guitar, and the correct or desired frequency to be generated by that element. In these instances, when the frequency difference becomes small or zero, the element is properly tuned. Examples of some of the known devices are disclosed in the U.S. Patents to Allen, U.S. Pat. No. 3,881,389, Iannone, U.S. Pat. No. 3,896,697, Rosado, U.S. Pat. No. 4,018,124, Arpino, U.S. Pat. No. 4,041,831, and Calvin, U.S. Pat. Nos. 4,078,469 and 4,122,751. As disclosed, these devices utilize visual indicators which are sometimes in the form of meters or lights which turn on or off depending on whether or not the vibratory element is in tune, digital displays of frequency deviations, and use in one instance, of a stroboscope to display frequency deviation as apparent movement of dark and light spots on a disk. The patent to Mackworth-Young, U.S. Pat. No. 3,631,756, discloses an indicator in the form commonly known as a "magic-eye" according to which fluorescing sectors are moved towards or away from one another depending on whether the vibratory element is approaching or retreating from a desired tuned frequency.

These patents are generally representative of the prior art and, although they were deemed to be advances in the state of the art at the time that they were conceived and reduced to practice, they exhibit a number of drawbacks which have been considered during the development of the present invention. For example, in many instances, the known devices utilize complicated electrical or electronic circuitry which necessarily results in a high initial cost and are subsequently expensive to maintain. However, a major drawback of those devices described in the patents recited above is the fact that the information displayed begins to degenerate at the instant the string is plucked with the result that such information is of questionable accuracy after the initial value is displayed. Thereafter, the musician is not able to rely on the information displayed, but is forced to guess the actual value albeit based to some extent on the information displayed. An additional drawback of the known devices is the fact that they do not generally inform the musician of the particular frequency of the vibratory element being examined; rather, they inform the musician of the difference between the frequency of the vibratory element, as actuated, and the desired frequency for that element. In most instances, a competent musician is aware of the general frequency range for a particular vibratory element, although he may not know the exact frequency for that element. In any event, most musicians would rather be informed of the particular frequency being generated by an activated element and make the appropriate adjustment to bring it into tune, than to know only the frequency deviation between the actual and desired frequency.

SUMMARY OF THE INVENTION

It was with recognition of these needs and of the state of the prior art that the present invention was conceived and has been reduced to practice. The present invention, then, relates generally to a method and apparatus including electronic circuitry for tuning a vibratory element of a musical instrument. The vibratory element may be, for example, the strings of a guitar, violin, or piano, or any other acoustically tuneable musical instrument. When a tuneable vibratory element of the instrument is actuated, the vibrations thereby created are converted into an electrical signal. This signal is operated upon to eliminate harmonic components, is sampled for a duration of one second, and is visually displayed on a readout device as a frequency registered in units of cycles per second. If the tunable element is actuated again, the display is zeroed and the frequency of the new signal will be displayed in place of the frequency of the previous signal, and if the tunable element is not actuated again within a predetermined period of time, twenty seconds, for example, the display on the readout device will return to zero.

The apparatus, as disclosed, indicates the actual frequency of a tunable vibratory element when actuated, as when a guitar string is plucked, and allows sufficient time for the musician to adjust or tune the element to the known, desired, frequency of that element. A primary feature of the invention, then, is that the indicated value remains displayed for a period of time sufficient to enable the musician to compare the displayed value to the standard value desired and thereby tune the element. Furthermore, if the musician actuates the same element while the previous value remains displayed, the new value will preempt the previous value and will itself be displayed and remain for a predetermined period of time or until it is, in turn, preempted. The invention is adaptable to both acoustical instruments and to electrically powered instruments, is highly accurate, is instantaneous in its operation, is compact, portable, and is light in weight. Additionally, the invention utilizes existing or state-of-the-art materials and components such that it is inexpensive to manufacture and maintain.

Other and further features of the invention will become apparent from the following description taken in conjunction with the following drawings. It is to be understood that both the foregoing general description and the following detailed description are exemplary and explanatory but are not restrictive of the invention. The accompanying drawings which are incorporated in and constitute a part of this invention, illustrate one embodiment of the invention, and together with the description, serve to explain the principles of the invention.

DESCRIPTION OF THE PREFERRED EMBODIMENT

Figure 1:
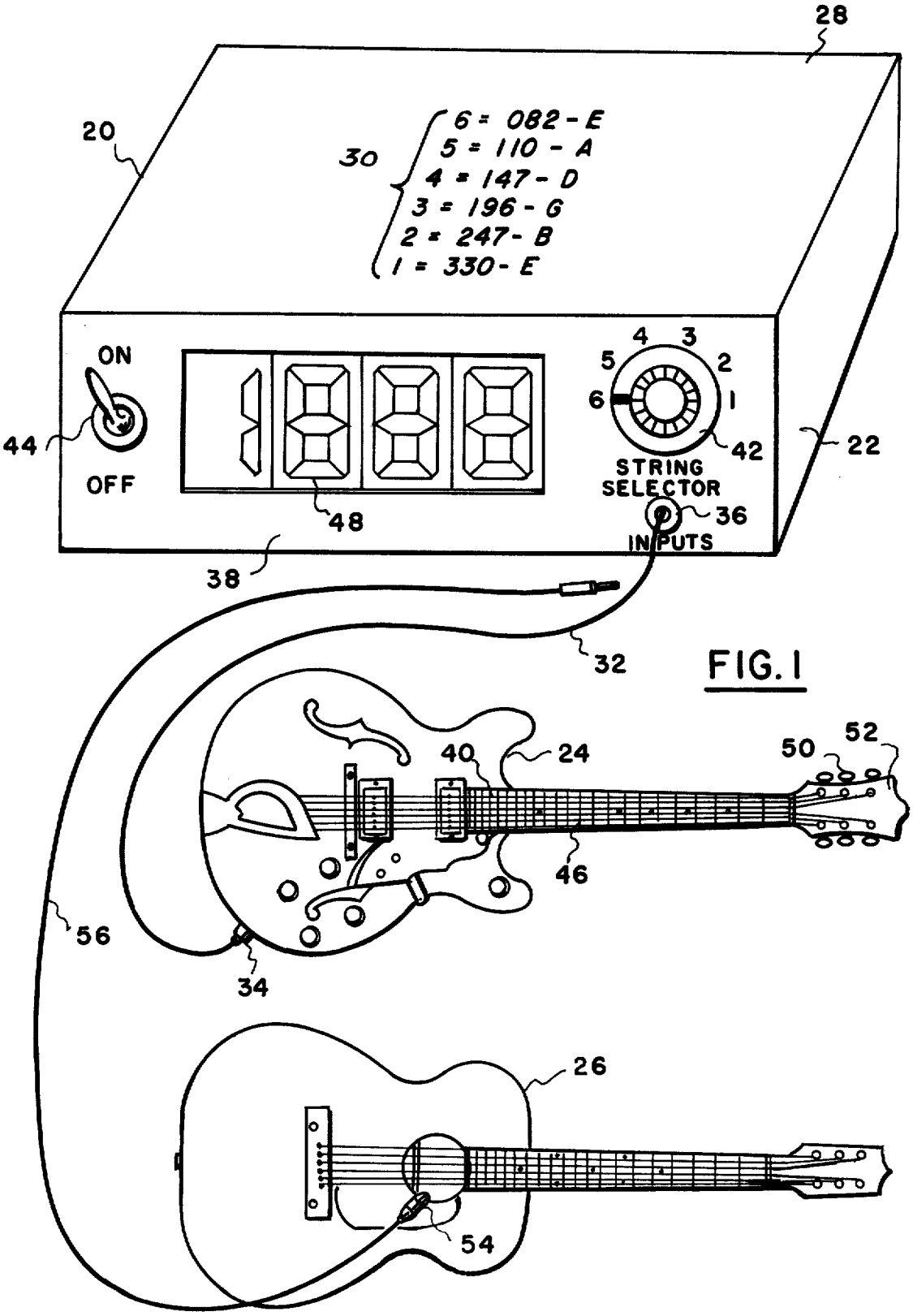
FIG. 1 is a perspective view of the invention illustrating the invention in operation and electrically connected to both an electrical guitar and an acoustical guitar.

Refer now to the drawings and initially to FIG. 1 which generally illustrates the invention as it is used in conjunction with stringed instruments. As illustrated, the invention is in the form of a tuning device 20 comprised of electronic circuitry and components, to be described, enclosed within a casing 22. As will be described in greater detail below, the tuning device 20 serves to inform a musician of the frequency value of a plucked string on a musical instrument such as a guitar. FIG. 1 illustrates both an electrical guitar 24 and an acoustical guitar 26, and the invention is applicable to either variety of instrument. It is further noteworthy that the invention is applicable to substantially any instrument having a vibratory element, strings or otherwise, and the invention should not be construed as being limited only to guitars or, indeed, stringed instruments.

A top panel 28 of the casing 22 is preferably provided with a legend as indicated by a bracket 30 providing the frequency and the notes associated with each string. As indicated, there are six such frequencies or notes, the guitar being a six stringed instrument, by definition. The electrical guitar 24 is electrically connected to the device 20 by means of a lead 32 extending between an output jack 34 on the guitar and an input jack 36 appropriately provided on a front panel 38 of the casing 22. The output jack 34 is electrically connected to a pick-up head (not illustrated) which serves to convert the movement of a string 40 into an electrical signal which can then be read at the output jack 34.

A string selector dial 42 is also suitably mounted on the front panel 38 and is selectively moveable to any one of six positions, each position being associated with a different string of the guitar 24. That is, by turning the string selector dial to the numeral "6", the pick-up for the associated string 40 is then being monitored and selectively processed by the circuitry within the tuning device 20. Thereupon, the device 20 is energized by means of a power switch 44 connecting its internal electronic circuitry to a suitable source of power.

With string selector dial 42 appropriately rotated to the number "6" position relating to that particular string whose frequency is to be determined, as shown in FIG. 1, that string is then plucked in the "open" position. The "open" position means that no fingers are placed on a fret 46 nor does any other object touch the string along its free length. A display 48, which may be of the digital variety provided in the front panel 38 of the casing 22, thereupon indicates a frequency value equivalent to the musical note at which the string is presently set. This value remains on the display for a moderate period of time, for example, for a period of 20 seconds or until the string is plucked again. If the number appearing on the display is not the same as the number appropriate for the particular string as indicated on the top panel 28, the musician turns a tuning peg 50 on the headpiece 52 of the guitar for that respective string and continues to pluck the string and adjust the tuning peg until the value indicated by the display 48 corresponds to the desired value for the string. This same procedure is used for tuning each of the remaining five strings.

The procedure in the instance of the acoustical guitar 26 is similar to that just described with respect to the electrical guitar 24. However, in this instance, a suitable pick-up 54 is applied to the guitar 26 and, in turn, connected to a lead 56. Thus, with the lead 56 connected to the input 36 of the tuning device 20, vibrations resulting from a plucked string on the guitar 26 will be translated into an electrical signal and read on the display 48.

In its broadest terms, the electronic circuitry within the tuning device 20, which will be described below, performs generally according to a sequence defined by the following steps: first, obtaining an input from a vibratory element, that is, a string 40, and converting the output into an electrical signal; second, deriving and providing as an output those portions of the electrical signal which are present within a generally narrow predetermined frequency range; third, monitoring the output from the second step for a first predetermined period of time; fourth, eliminating any further input from the second step for a second predetermined period of time; and fifth, visually displaying the frequency of the vibratory element for no longer than the second predetermined period of time.

The sequence just recited may include an additional, or sixth, step of returning a display mechanism utilized for visually displaying the frequency of the vibratory element to a zero condition after lapse of the second predetermined period of time. Also, the sequence may include a seventh step of resetting the display mechanism utilized for visually displaying the frequency of the vibratory element to a zero condition prior to displaying a frequency for a new input. This seventh step may be in place of, or in addition to, the sixth step.

In accordance with the invention, the apparatus to be disclosed comprises input means for converting into an electrical signal substantially of sine wave shape the acoustic vibrations of a tunable element of the instrument; filter means for deriving and providing as an output those portions of said electrical signal which are present within a generally narrow predetermined frequency range; display means operable to provide a visual indication of the frequency of the vibratory element; a first one-shot pulse generator operable to provide an output timing pulse of predetermined limited duration; actuating means responsive to said output of said filter means when said output is greater than a predetermined level for operating said first one-shot pulse generator; sample and hold means operable to receive the output from said filter means for operating said display means; first switch means for electronically connecting said filter means and said sample and hold means resulting in operation of said sample and hold means by the output from said filter means and responsive to operation of said first pulse generator for opening said first switch means and electronically disconnecting said filter means and said input means; a second one-shot pulse generator responsive to the output timing pulse from said first pulse generator operable to provide an output timing pulse of extended duration; and second switch means responsive to operation of said second pulse generator for change to a conductive state to electronically connect said sample and hold means and said display means resulting in operation of said display means for a predetermined extended period of time.

Figure 2:
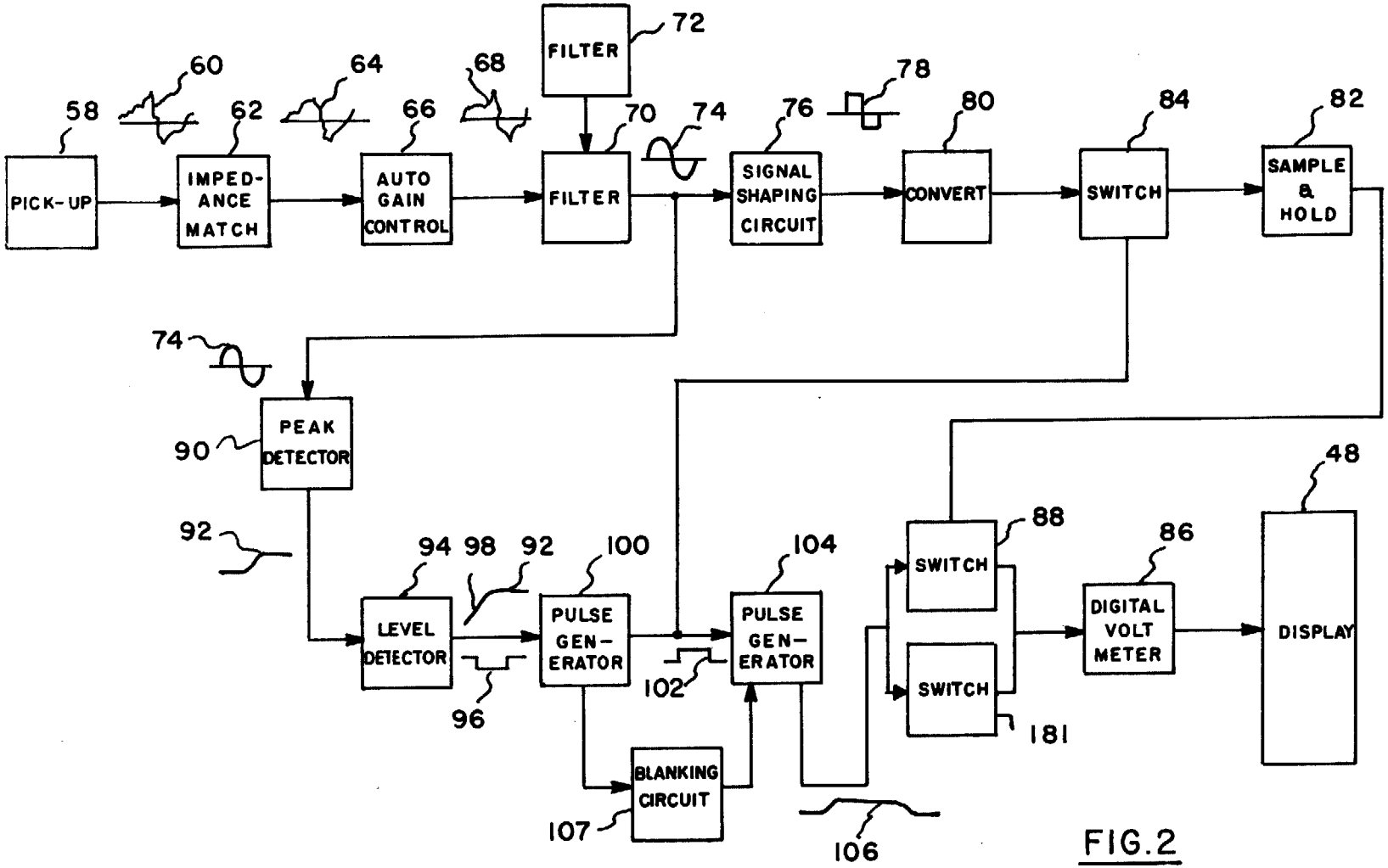
FIG. 2 is a block diagram disclosing a system for measuring the vibration frequency of a vibratory element according to the present invention.

As embodied herein, the invention will be initially described with the aid of FIG. 2 which presents a block diagram of the basic invention. Subsequently, reference will be made to FIG. 3 which presents specific electronic circuitry illustrative of portions of the block diagram. Accordingly, with initial reference to FIG. 2, the sound produced when the guitar string 40 is plucked is received by a pick-up 58 and fed to the input 36 of the device 20 (FIG. 1) as previously described. The sound of the plucked string is converted by the pick-up 58 into an electrical signal substantially of sine wave shape as represented by the reference numeral 60. An impedance match circuit 62 (utilizing, for example, a Radio Shack 843LF353N15, or equivalent, and associated components) thereupon matches the impedance of the signal 60 to that of the following circuit, the output from the circuit 62 being generally indicated as a signal 64. A two-stage auto gain control 66 (utilizing, for example, a National LM324N, or equivalent, and associated components) serves to receive the signal 64 and maintain it as a steady amplitude represented by a signal 68 as the movement of the string 40 decays. Blocks 70 and 72 together comprise a state variable active bandpass filter (utilizing, for example, a National LM324N, or equivalent, and associated components) which is adjustable for the basic narrow bandwidth of frequencies of each of the six strings. The purpose of the filter 70, 72 is to eliminate the harmonic frequencies which are generated by a string when plucked and disallows any frequencies from adjacent strings inadvertently being processed. The result is a sharp signal 74 or, in other words, those portions of the electrical signal 68 which are present within a generally narrow predetermined frequency range. For example, if the frequency being sought is 330 cps, the filter 70, 72 might allow passage of those portions of an electrical signal within a frequency range approximately between 310 cps and 350 cps.

After the signal 74 is operated upon in a manner which will be described below, the frequency of that signal will be visually provided by the display 48 to which reference has previously been made as being located on the front panel 38 of the casing 22.

A signal shaping circuit 76 operates on its input signal 74 (which is of sine wave shape) to produce an output signal 78 which is of square wave form but at the same basic frequency as the input signal. A frequency/voltage converter 80 serves to operate on the signal 78 and produce a d.c. output which is proportional to the frequency of the signal 78. A sample and hold circuit 82 operates on the output signal from the frequency/voltage converter 80, the signal being directed via a first electronic switch 84 and averages and holds that output signal and gates it to a digital voltmeter 86 through a second electronic switch 88. Such gating through the switches 84 and 88 must be achieved at the proper time as will be disclosed below.

To this end, it is noteworthy that a peak detector 90 receives the signal 74, and generates an output signal 92 which is representative of the initial oscillations of the string 40. A level detector 94, which operates in conjunction with the peak detector 90, generates an output signal 96 which occurs at a trip point 98 of the signal 92 and triggers a first one-shot pulse generator circuit 100 which is operational for a duration of one second to change the switch 84 to the conductive state. The trailing edge of an output signal 102 from the circuit 100 triggers a second one-shot pulse generator circuit 104 which is operational for a duration of twenty seconds. An output signal 106 from the circuit 104 thereby serves to remove the ground signal that zeroes the display and changes the switch 88 to the conductive state for the predetermined interval of twenty seconds so as to permit the output from the sample and hold circuit 82 to be fed to the digital voltmeter 86 and indicated on the display 48 for that period of time.

When the twenty-second, or other desired predetermined interval of time, has passed, the electronic switch 88 will again open eliminating the signal to the digital volt meter 86 and returning the display 48 to a zero condition. In the event the string 40 is plucked again before the twenty-second interval has passed, in a manner which will be discussed more completely below, the electronic switch 88 is again opened momentarily to return the display 48 to a zero condition before providing a visual indication of the updated information.

Thus, the pulse generator 100 is operable to provide an output timing pulse of predetermined limited duration, one-second, for example, and the peak detector 90 and level detector 94 together serve as actuating means responsive to the output of the filter means 70, 72 when that output is greater than a predetermined level, as determined by the trip point 98, for operating the pulse generator 100. Simultaneously, the sample and hold means 82 is operable to receive the output from the filter means 70, 72 (through the converter 80) for operating the display means 48. Furthermore, the first switch means 84 electronically connects the filter means 70, 72 and the sample and hold means 82 resulting in operation of the sample and hold means by the output from the filter means but in response to operation of the pulse generator 100 electronically opens the first switch means 84 thereby electronically disconnecting the sample and hold means 82 from the input. Additionally, a second pulse generator 104 is responsive to the output timing pulse from the pulse generator 100 to provide an output timing pulse of extended duration (for example, twenty seconds) and the second switch means 88 is responsive to operation of the second pulse generator 104 for change to a conductive state to electronically connect the sample and hold means 82 and the display means 48 resulting in operation of the display means for a predetermined extended period of time.

In accordance with the invention being generally as previously described, said apparatus includes blanking means operable to change said second switch means to the non-conductive state to thereby electronically disconnect said sample and hold means and zero said display means upon introduction to said input means of a subsequent acoustic vibration within the predetermined extended period of time. As embodied herein, with continued reference to FIGS. 2 and 3, it will be understood that if the string is again plucked during the twenty second interval, a negative signal is routed through a blanking circuit 107 which in turn terminates the twenty second pulse causing a switch 181 (FIG. 3) to apply a ground potential to the display 48 thus causing it to display zero. It must be noted at this time that the signal out of the blanking circuit 107 will have an effect on changing the state of the display only during the twenty seconds of display time, therefore constituting it as a reset circuit only.

In accordance with the invention being generally as previously described, said input means includes a moveable vibratory element of a musical instrument of the acoustic variety operable to produce acoustic vibrations when moved and a pickup responsive to operation of said vibratory element for generating an electrical signal of sine wave shape corresponding to the acoustic vibrations produced by said vibratory element. As embodied herein, with particular reference to FIG. 1, it will be appreciated, as previously described, that a musical instrument to be tuned may be of the acoustical variety, such as the acoustical guitar 26. As disclosed, a suitable pickup 54 is physically attached to the guitar 26, and is, in turn, connected to a lead 56 whereby vibrations resulting from a plucked string on the guitar 26 will be translated into an electrical signal and eventually read on the display 48.

In accordance with the invention being generally as previously described, said input means includes a moveable vibratory element of a musical instrument of the electrical variety operable to produce electrical signals corresponding to the movement thereof and a suitable pickup responsive to operation of said vibratory element for generating an electrical signal of sine wave shape corresponding to the electrical signals produced by said vibratory element.

As embodied herein, with continuing reference to FIG. 1, it has been previously explained that the electrical guitar 24 is electrically connected to the device 20 by means of a lead 32 extending between the output jack 34 on the guitar and an input jack 36 appropriately provided on the front panel 38 of the casing 22. In this fashion, the output jack 34 is electrically connected to a pickup head (not illustrated) which serves to convert the movement of the string 40 into an electrical signal which can then be read at the output jack 34, and eventually, on the display 48.

In accordance with the invention being generally as previously described, shaping means are provided for converting the sine wave shaped output of said filter means into the form of a square wave; and converter means are operative to provide a d.c. output proportional to the frequency of the square wave output from said shaping means; and said sample and hold means is operable to receive the d.c. output from said converter means for operating said display means and said first switch means electronically connects said converter means and said sample and hold means resulting in operation of said sample and hold means by the d.c. output from said converter means and is responsive to operation of said first pulse generator for changing said first switch means to a non-conductive state and electronically disconnecting said filter means and said input means.

As embodied herein, with reference once again to FIG. 2 the circuit 76 serves to reshape the sine wave signal 74 into a square wave signal 78 and the frequency/voltage converter circuit 80 serves to provide a d.c. output signal proportional to the frequency of the square wave output 78 from the signal shaping circuit 76. Furthermore, the sample and hold circuit 82 is operable to receive the d.c. output from the converter circuit 80 for operating the display 48. In this regard, the first switch 84 electronically connects the converter circuit 80 and the sample and hold circuit 82 resulting in operation of the sample and hold circuit by the d.c. output from the converter 80 and is responsive to operation of the first pulse generator 100 for its opening, thereby electronically disconnecting the converter circuit 80 from the sample and hold circuit 82.

Although the basic concept of the invention should be reasonably well understood by the reader at this stage of the disclosure, it is considered that it would be of benefit to disclose one form of electronic circuitry which can be used to achieve the results expressed by the inventor. To this end, attention is directed to FIG. 3 which is a schematic diagram of the electronic circuitry illustrative of portions of the block diagram illustrated in FIG. 2.

Figure 3:
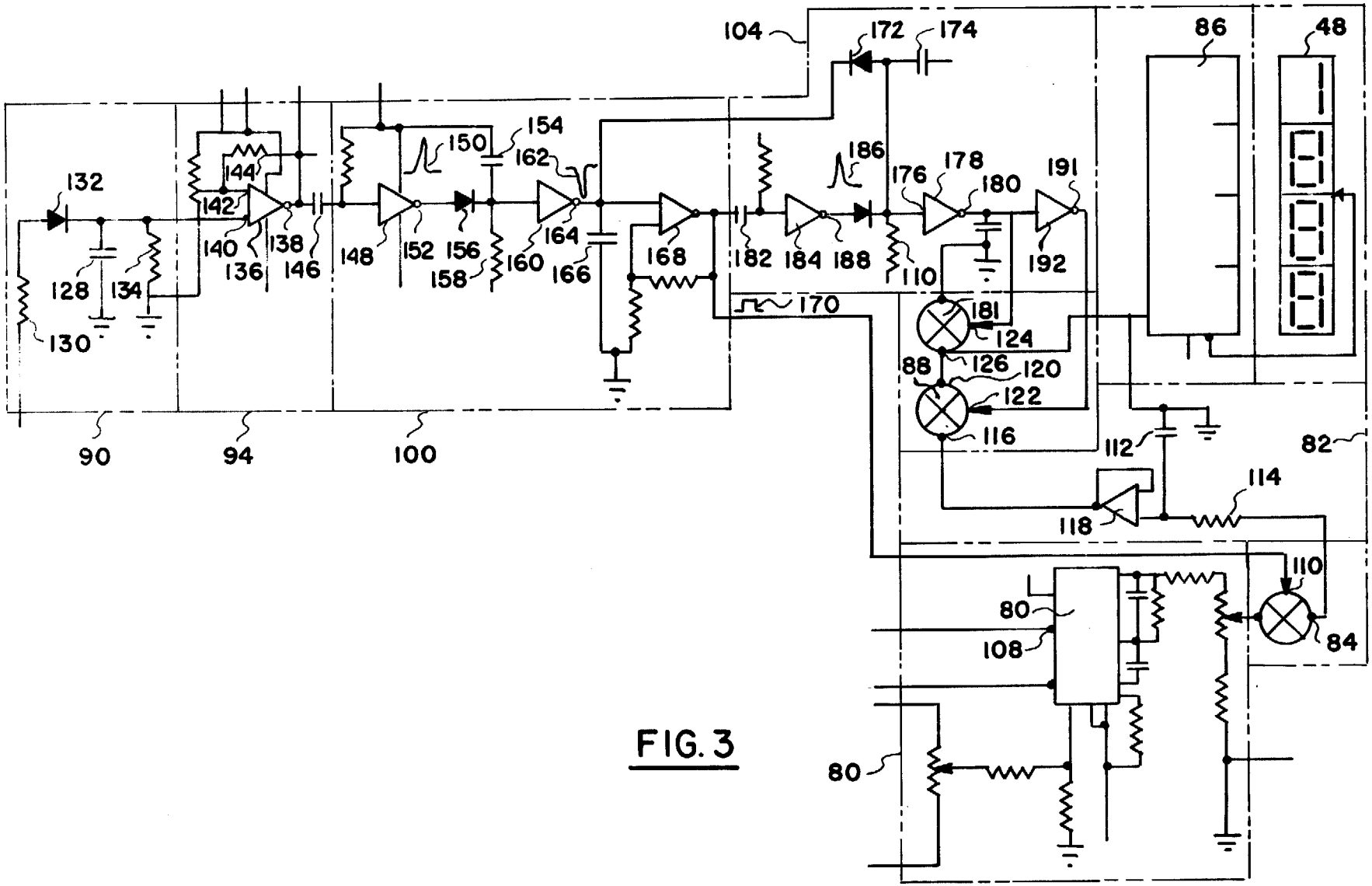
FIG. 3 is a schematic diagram of the electronic circitry illustrative of portions of the block diagram illustrated in FIG. 2.

With reference now to FIGS. 2 and 3, consider initially the electrical path taken by a signal passing by way of the frequency/voltage converter 80, first switch 84, sample and hold circuit 82, the second switch 88, the digital voltmeter 86, and terminating at the display 48. The frequency/voltage converter 80 may be a Radio Shack 9400 CJ, or equivalent, whose output, as previously explained, is proportional to the frequency of its input at a pin 108. The first electronic switch 84 receives and passes the d.c. level output from the converter 80 when the switch control voltage at a pin 110 is high for a period of one second. The d.c. output thereby passed by the switch 84 charges a high quality capacitor 112 through a resistor 114 for a period of ten time constants (five time constants generally being required for a full charge on a capacitor) to thereby insure a full charge on the capacitor. This d.c. level signal is then fed to a pin 116 of the second electronic switch 88 via a high impedance source follower 118 (Radio Schack Dual BI-FET OP AMP 843LF353N15, or equivalent, and associated components) which is employed to prevent the capacitor 112 from discharging.

The d.c. signal out of the source follower 118, as previously explained, is fed through the electronic switch 88 via pin 116 and a pin 120 and on to the digital voltmeter 86 when the control signal at a pin 122 of the switch 88 is high for a duration of twenty seconds. However, before this signal can be sent to the digital voltmeter 86, a pin 124 of the electronic switch 181 has to go low to remove the ground level at a pin 126 which is used to zero the display 48.

With a discussion of the path of a signal from the frequency/voltage converter 80 to the display 48 now as a background, consider the path of a signal from the state variable filter 70, 72 to the display 48. The a.c. signal output of the state variable filter 70, 72 is fed to a peak detector circuit 90 and charges a capacitor 128 through a resistor 130 from ground to a maximum of 1.5 volts less the IR drop across a diode 132 (IN 914, or equivalent). A resistor 134 is used to discharge the capacitor 128 when the signal is removed from it. The resistor 130 is preferably of a low value to prevent any short spikes in the signal from triggering the level detector 94, partially represented as a quad op amp (National LM 324N, or equivalent, and associated components). With this arrangement, it would require a chain of pulses to charge the capacitor 128 to a level sufficient to trigger the level detector instead of a random noise spike. An output pin 138 of the inverting level detector 136 (National LM 324N, or equivalent, and associated components) changes state from +5 volts d.c. to −5 volts d.c. when the value of a signal at an input pin 140 exceeds the setting on a pin 142. A resistor 144 provides hysteresis so as to prevent oscillations in the signal from being processed. The level change on pin 138 from +5 to −5 volts d.c. causes a capacitor 146 to instantaneously change to a −5 volts d.c. The −5 volts d.c. pulse is thereupon inverted by a hex inverter 148 to give a positive pulse 150 at a pin 152.

The pulse 150 instantaneously discharges a capacitor 154 through a diode 156 (IN 914, or equivalent). The circuit arrangement is such that the capacitor 154 slowly charges through a resistor 158, the time constant of the capacitor 154 and the resistor 158 being set for one second. The resulting positive one second pulse is then inverted by a hex inverter 160 resulting in a negative one second pulse 162 at its output pin 164. A capacitor 166 is provided to prevent oscillations when the inverter 160 operates on the signal to change its state.

The signal 162 is routed to a quad op amp 168 (National LM324N, or equivalent) which is configured as an inverting comparator and used to wave shape the one second pulse into a square wave signal 170 which is used to turn on the electronic switch 84 as previously discussed.

A signal across a capacitor 182 of the pulse generator 100 first goes positive on the leading edge of the one second pulse, then goes negative with the trailing edge of the one second pulse. The negative going signal then triggers a hex inverter 184 (Radio Shack SIL4049BC, or equivalent) which in turn puts out a positive pulse 186 at a pin 188. This pulse 186 instantaneously discharges a capacitor 174 and also shuts off a hex inverter 178 (Radio Shack SIL 4049BC, or equivalent). At this point, the capacitor 174 begins to charge through a resistor 190, taking approximately twenty seconds to charge to the trip point of the inverter 178. During this twenty second interval, the pin 180 assumes a negative state which is applied to pin 124 of electronic switch 181, thereby opening the switch 181 which removes the ground potential to the digital voltmeter 86 and causes a pin 191 of a hex inverter 192 (Radio Shack SIL4049BC, or equivalent) to go positive and is applied to pin 122 of electronic switch 88 which allows the d.c. value on a capacitor 112, after one second of sampling time, to be displayed through the digital voltmeter 86.

The signal 162 is also routed to the twenty second pulse generator 104 through the diode 172 to instantaneously charge the capacitor 174. Such a procedure serves to terminate the twenty second output by applying −5 volts d.c. to the pin 176 of the hex inverter 178 which inverts the signal and applies the +5 volts d.c. from the output pin 180 to the electronic switch 181. This, in turn, serves to apply a ground potential to the digital voltmeter 86 thereby restoring the display 48 to a zero condition.

Thus, it should now be clear that when a string 40 is plucked in the open position, the display 48 of the tuning device 20 will exhibit a digital value equivalent to the frequency of the musical note at which the string is set. This value will remain on the display 48 for approximately 20 seconds or until the string is plucked again. After a period of 20 seconds has passed, the value appearing on the display 48 will return to zero. If the string 40 is plucked again within the 20-second interval during which a value is presently appearing on the display, the new value will preempt the previous value. After the passage of 20 seconds from the time the string was last plucked, the value on the display will become zero.

The invention, in its broader aspects, is not limited to the specific details shown and described; departures may be made from such details without departing from the principles of the invention and without sacrificing its chief advantages.

What is claimed is:

1. A method for determining the frequency of the vibratory elements of a musical instrument comprising the following steps:

(a) providing a vibratory element;

(b) causing the vibratory element to oscillate;

(c) obtaining as an input the oscillations from the vibratory element and converting the input into an electrical signal;

(d) deriving and providing as an output those portions of the electrical signal which are present within a generally narrow predetermined frequency range;

(e) monitoring the output from step (d) for a first predetermined period of time;

(f) eliminating any further input from step (d) for a second predetermined period of time at the conclusion of the first period of time; and (g) visually displaying the frequency of the oscillations of the vibratory element for no longer than the second predetermined period of time.

2. A method as set forth in claim 1 including the additional step of returning a display mechanism utilized for visually displaying the frequency of the oscillations of the vibratory element to a zero condition after lapse of the second predetermined period of time.

3. A method as set forth in claim 1 including the additional step of resetting a display mechanism utilized for visually displaying the frequency of the oscillations of the vibratory element to a zero condition prior to displaying a frequency for a new input.

4. Apparatus for use in tuning a musical instrument having tunable vibratory elements comprising:

input means for converting into an electrical signal substantially of sine wave shape the acoustic vibrations of a vibratory element of the instrument;

filter means for deriving and providing as an output those portions of said electrical signal which are present within a generally narrow predetermined frequency range;

display means operable to provide a visual indication of the frequency of the vibratory element;

a first one-shot pulse generator operable to provide an output timing pulse of predetermined limited duration;

actuating means responsive to said output of said filter means when said output is greater than a predetermined level for operating said first one-shot pulse generator;

sample and hold means operable to receive the output from said filter means for operating said display means;

first switch means for electronically connecting said filter means and said sample and hold means resulting in operation of said sample and hold means by the output from said filter means and responsive to operation of said first pulse generator for changing said first switch means to a non-conductive state and electronically disconnecting said filter means and said input means;

a second one-shot pulse generator responsive to the output timing pulse from said first pulse generator operable to provide an output timing pulse of extended duration; and second switch means responsive to operation of said second pulse generator for change to a conductive state to electronically connect said sample and hold means and said display means resulting in operation of said display means for a predetermined extended period of time.

5. Apparatus as set forth in claim 4 including blanking means operable to change said second switch means to the non-conductive state to thereby electronically disconnect said sample and hold means and zero said display means upon introduction to said input means of a subsequent acoustic vibration within the predetermined extended period of time.

6. Apparatus as set forth in claim 4 wherein said input means includes a tunable vibratory element of a musical instrument of the acoustical variety operable to produce acoustic vibrations when moved and a pickup responsive to operation of said vibratory element for generating an electrical signal of sine wave shape corresponding to the acoustic vibrations produced by said vibratory element.

7. Apparatus as set forth in claim 4 wherein said input means includes a tunable vibratory element of a musical instrument of the electrical variety operable to produce electrical signals corresponding to the movement thereof and a pickup responsive to operation of said vibratory element for generating an electrical signal of sine wave shape corresponding to the electrical signals produced by said vibratory element.

8. Apparatus as set forth in claim 4 including shaping means for converting the sine wave shaped output of said filter means into the form of a square wave; and converter means operative to provide a d.c. output proportional to the frequency of the square wave output from said shaping means; and wherein said sample and hold means is operable to receive the d.c. output from said converter means for operating said display means and wherein said first switch means electronically connects said converter means and said sample and hold means resulting in operation of said sample and hold means by the d.c. output from said converter means and is responsive to operation of said first pulse generator for changing said first switch means to a non-conductive state and electronically disconnecting said filter means and said input means.

* * * * *